United States Patent [19]

Guise, Jr.

[11] 4,058,315

[45] Nov. 15, 1977

[54] MARBLE SHOOTING GAME

[76] Inventor: Arthur A. Guise, Jr., Rte. 1, Box 465, Chauvin, La. 70344

[21] Appl. No.: 645,707

[22] Filed: Dec. 31, 1975

[51] Int. Cl.[2] ..... A63F 7/00

[52] U.S. Cl. ..... 273/118 R; 273/127 D

[58] Field of Search ..... 273/102.1 G, 108, 109, 273/110, 118–129, 38, 41

[56] References Cited

U.S. PATENT DOCUMENTS

| | | | |
|---|---|---|---|
| 575,950 | 1/1897 | Hess | 273/123 R |
| 971,626 | 10/1910 | Nelson | 273/127 D |
| 3,899,170 | 8/1975 | Parks et al. | 273/127 D X |

FOREIGN PATENT DOCUMENTS

| | | | |
|---|---|---|---|
| 519,892 | 12/1955 | Canada | 273/38 |
| 451,086 | 2/1913 | France | 273/123 R |
| 118,020 | 12/1926 | Switzerland | 273/120 R |
| 489,871 | 8/1938 | United Kingdom | 273/127 D |

*Primary Examiner*—Richard J. Apley
*Attorney, Agent, or Firm*—Clarence A. O'Brien; Harvey B. Jacobson

[57] ABSTRACT

A marble shooting game having a playing apparatus which includes a playing surface which is divided into two longitudinal segments with one segment having a foul line and a marble holder and projector at the other end of the segment and with the other segment portion being identically arranged except for the marble holder and projector being adjacent the foul line of the first segment and the foul line of the second segment being adjacent the marble holder and projector of the first segment so that a player shooting at a target associated with the marble holder and projector at the opposite end of one segment will release a marble placed on said holder by an opposing player.

2 Claims, 4 Drawing Figures

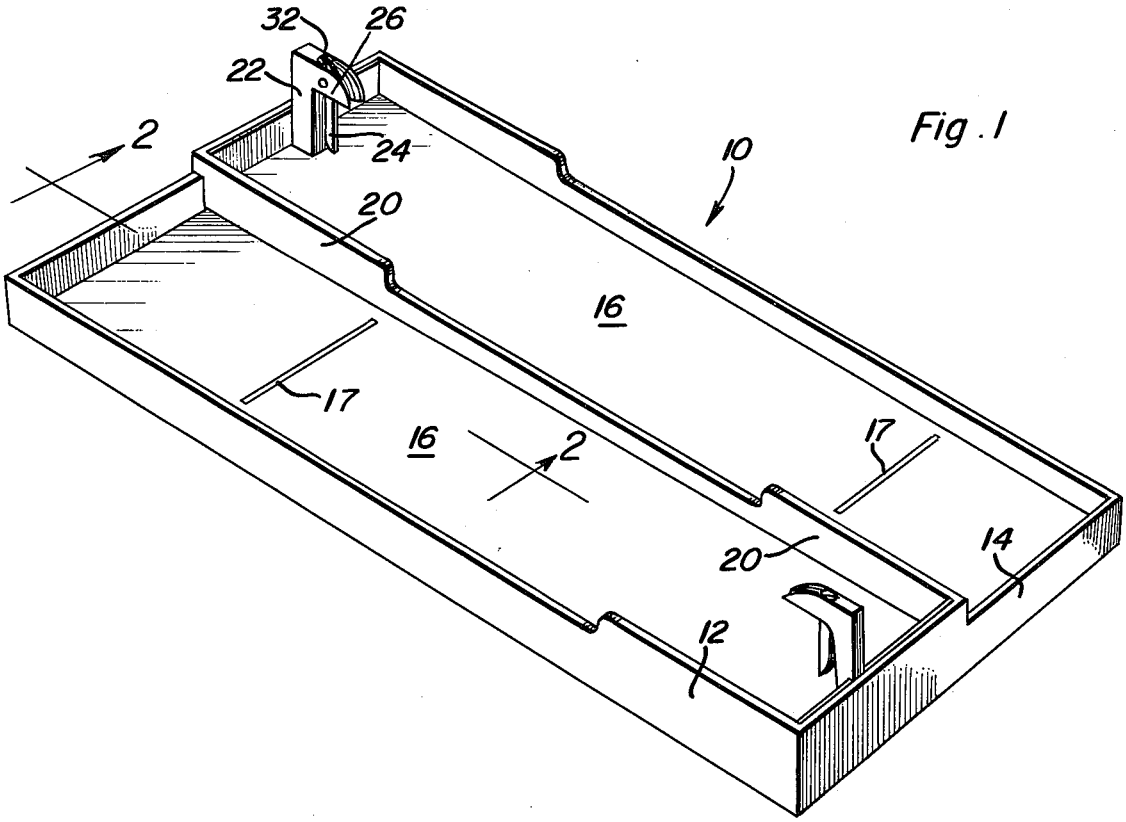
Fig. 1
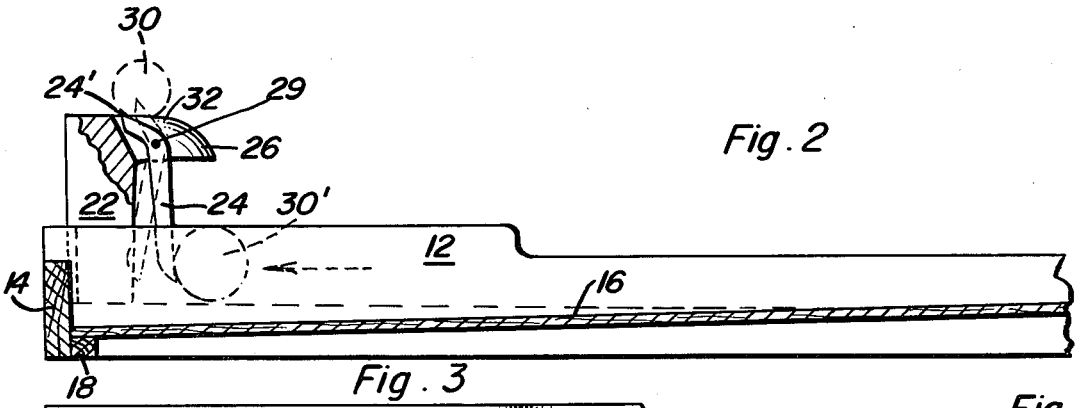
Fig. 2
Fig. 3
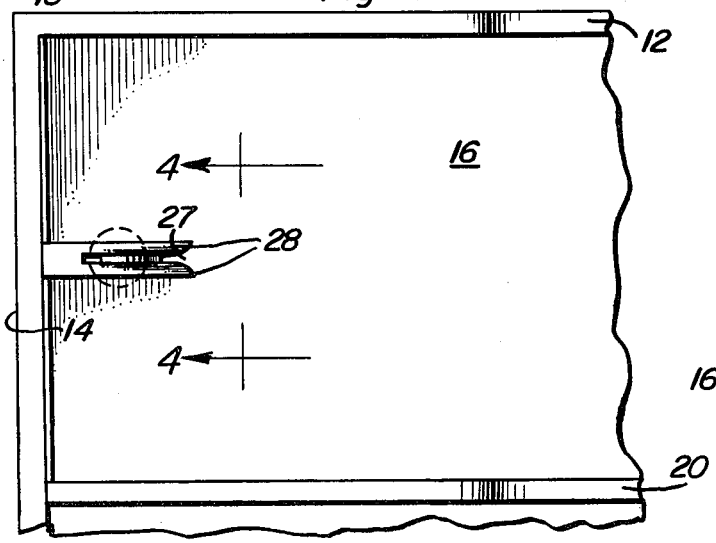
Fig. 4
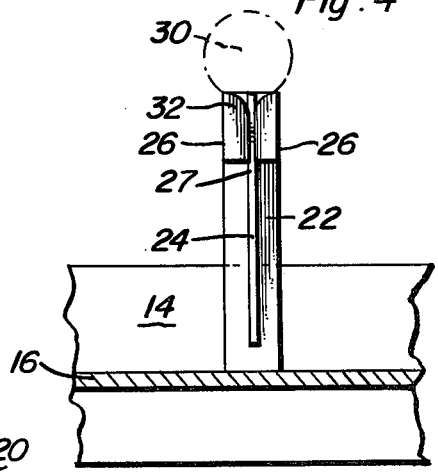

MARBLE SHOOTING GAME

BACKGROUND OF THE INVENTION

1. Field of the Invention

This invention relates generally to marble games and particularly to a type marble game employing marble holders with targets associated therewith for projecting a marble being held when the associated target is hit by an opponent.

2. Description of the Prior Art

A common problem with games employing marbles is that if any distance is involved in order to increase the degree of skill necessary to hit a target, the retrieval of the marbles or other projectiles becomes a problem.

Another common problem with marble type games is that often the marbles are easily lost, and are not confined to designated playing areas with any positive means for confining same.

A further problem of many games of all types is the number of parts involved which adds complexity to at least the physical structure of the game, if not the game itself. It is highly desirable to provide a marble type target hitting game which avoids the problems set forth above.

Known prior art patents which may be pertinent to this invention are listed as follows:

T. Morley, U.S. Pat. No. 138,038 filed on Apr. 22, 1873;

D.C. Mitchell, U.S. Pat. No. 957,472 filed on May 10, 1910;

F.H. King, U.S. Pat. No. 2,097,670 filed on Nov. 2, 1937

F.H. King, U.S. Pat. No. 2,236,572 filed on Apr. 1, 1941;

F. Shackleford, U.S. Pat. No. 2,372,608 filed on Mar. 27, 1945;

F.H. King, U.S. Pat. No. 2,455,012 filed on Nov. 30, 1948.

SUMMARY OF THE INVENTION

An object of the present invention is to provide a marble game amusement device which is low in cost, has a minimum of operating parts, and is simple and easy to play.

Another object of the present invention is to provide a marble type game and amusement device which may be played by two people and inherently eliminates the normal amount of chasing in order to retrieve the shot marbles.

A further object of this invention is to provide a simple, yet positive operating marble holding amusement device which has a target associated therewith and upon the target being hit will propel the marble being held across the surface of the game table.

A still further object of the amusement device of this invention is to provide a two player game board which is inherently self-loading and self-operating through the basic operation of the players without requiring any complicated structural apparatus to effect the operation thereof.

An important feature of the game apparatus disclosed by this invention is the fact that two players stand at opposite ends and facing each other diagonally across the game table of the device so that the marbles shot by one player will be in easy retrievable reach of the opposite player. This eliminates the normal wasted effort in chasing and retrieving marbles and projectiles as is normal in games of this type.

Another important feature is the simple structure of the game table itself and the simple operating mechanism of the trigger head for holding and shooting the marbles of the game. Few working parts are necessary for this device and those that are necessary are extremely simple and require very little maintenance and chance of breakage.

This game is simple to construct by either a game manufacturer or even by the home craftsman and offers a great deal of fun to anyone playing the game.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the game board and trigger head structure of this invention.

FIG. 2 is a cross-sectional view, in part, taken generally along line 2—2 of FIG. 1.

FIG. 3 is a top plan view, in part, of the upper left-hand corner of the game board of FIG. 1.

FIG. 4 is a cross-sectional view, in part, taken generally along line 4—4 of FIG. 3.

DESCRIPTION OF THE PREFERRED EMBODIMENT

Referring to FIG. 1 of the drawing, reference numeral 10 indicates the game board of the amusement device of this invention. The basic structure of the game board has sides 12 and 14 recessed as shown for ease of playing and access to the game board surface itself. Said game board surface 16 may be a single board or two identical boards side by side made of plywood or other strong material. Generally the game board 16 would be a single piece with the partition member 20 resting on the top surface thereof and appropriately connected between ends 14, at the middle of ends 14, to divide the game surface 16 into two long rectangular segments as best seen in FIG. 1. A supporting brace 18, as seen in FIG. 2, shown at only one end of the joint between the game board surface 16 and an end wall 14, normally is provided at both ends for strength and rigidity of the over-all device.

A foul line is appropriately marked, or inscribed or recessed into the game board segments as at 17. This is the line which the player adjacent thereto should not go over while playing the game. Each segment of the game board opposite to the foul lines has provided a trigger-head mechanism which consists of a support stand 22 having right-angle projecting ears 26 extending therefrom with a recess or slot 27 between the ears 26. A trigger lever 24 is pivotally suspended within the slot 27 by means of a pivot hinge pin 29 which is appropriately press-fitted into corresponding holes in the projecting ears 26. The projecting ears 26 have a beveled or tapered inner surface thereof 28. This tapering provides a channel or dished portion along the upper surface of the marble-holding head for reception and support of a marble 30 thereby. A small retaining bar 32 is appropriately set into the upper edges of the projections 26 to complete the support area for the marble 30. As can best be seen in FIG. 2, the upper end of the lever 24 on the other side of the pivot pin 29, labeled 24', normally rests against the left bottom portion of the marble as viewed in this figure.

As seen in FIG. 2, another marble, shown in dotted lines 30', when rolled along the associated game surface will, if it strikes the target lever 24, cause the lever to pivot around point 29 to force the striking portion 24' to hit the stationary marble resting on top of the trigger head and said mechanism will catapult or project the marble 30 off the trigger head onto the game table and to the other end of the game board.

Operation of this game is as follows: each player, possessing the desired number of marbles, stands at the opposite end of the game board from the trigger head, and in this position, the players are facing each other diagonally across the game table. Each player then places a marble on top of the trigger head in the bowl-shaped indentation thereon which is to his immediate left. As the game begins each player attempts to shoot a marble from behind the foul line 17 toward the trigger lever 24 attached and suspended from the trigger head. If a player propels a marble in an accurate and targethitting direction, the marble will strike the lever 24, the lever in turn dislodges the marble placed thereon by the opposite player or opponent, onto the table, thereby allowing the dislodged marble to roll to the player on the same side. The object of the game is to dislodge as many marbles as possible from the top of the trigger head by striking the lever with the marble that is manually shot or rolled from the opposite end of the table, thereby causing one's opponent to use all of his marbles in replacing those marbles dislodged and kept by his opponent; the player who runs out of marbles first is considered the loser.

This game is new and unique to the field of marble-type games and eliminates many of the disadvantages normally found in such type games as elaborated on above.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A game apparatus comprising; means for playing a game with marbles with a reduced chance of losing the marbles including, a game board with sides, support means on said game board for supporting a first marble thereon, and additional means associated with the support means functioning as a target and which when hit by another marble will project said first marble onto the surface of the game board, said support means including a stand structure attached vertically to one end of said game board and having a marble-holding indentation at the top thereof, said additional means including a target lever associated with the supporting stand structure to actuate a marble-disengaging lever on said support stand structure when the target lever is hit by another marble, said target lever being pivotally supported between parallel ears on the support stand structure which form the indentation therebetween for supporting the first marble and allow said first marble to be projecting off the support when the target lever is actuated by being hit by another marble.

2. The game as set forth in claim 1 wherein the stand structure and target lever are at one end of said game board and a foul line is provided adjacent the other end of the game board, said apparatus including two such game boards provided on a single structure so as to be in side-by-side relationship but with the foul line of one game board being closely beside the support and target structure of the other game board and similarly the support and target structure of the one game board at the other end thereof is closely adjacent the foul line of the other game board.

* * * * *